US005598582A

United States Patent [19]

Andrews et al.

[11] Patent Number: 5,598,582

[45] Date of Patent: Feb. 4, 1997

[54] HEAT RESISTANT AND CUT AND PUNCTURE PROTECTIVE HAND COVERING

[75] Inventors: Warren L. Andrews; Georges N. Karam, both of Chicago, Ill.

[73] Assignee: Marmon Holdings, Inc., Chicago, Ill.

[21] Appl. No.: 398,935

[22] Filed: Mar. 6, 1995

[51] Int. Cl.[6] ..... A41D 19/00; A41D 13/10

[52] U.S. Cl. ..... 2/16; 2/2.5; 2/161.6; 2/161.8; 2/164; 2/167

[58] Field of Search ..... 2/158, 159, 161.3, 2/161.6, 161.7, 161.8, 164, 167, 168, 169, 81, 16, 2.5

[56] References Cited

U.S. PATENT DOCUMENTS

| | | | |
|---|---|---|---|
| 3,548,413 | 12/1970 | Jackson . | |
| 3,739,400 | 6/1973 | Colehower . | |
| 3,881,197 | 5/1975 | Andrews . | |
| 3,883,898 | 5/1975 | Byrnes, Sr. | 2/167 |
| 4,001,895 | 1/1977 | Cohen . | |
| 4,089,069 | 5/1978 | Vistins . | |
| 4,342,121 | 8/1982 | Vistins . | |
| 4,433,439 | 2/1984 | Sidman et al. . | |
| 4,454,611 | 6/1984 | Tschirch et al. . | |
| 4,559,646 | 12/1985 | Ertl | 2/16 |
| 4,733,413 | 3/1988 | Dykstra | 2/169 |
| 4,779,290 | 10/1988 | Welch et al. . | |
| 4,918,756 | 4/1990 | Grilliot | 2/164 |
| 5,050,241 | 9/1991 | Flowers et al. | 2/81 |
| 5,117,509 | 6/1992 | Bowers . | |
| 5,119,515 | 6/1992 | Altinger | 2/81 X |
| 5,146,628 | 9/1992 | Herrmann et al. | 2/161.8 X |

FOREIGN PATENT DOCUMENTS

| | | |
|---|---|---|
| 0482618 | 10/1991 | European Pat. Off. . |
| WO9305670 | 4/1993 | WIPO . |

*Primary Examiner*—Paul C. Lewis
*Attorney, Agent, or Firm*—Keck, Mahin & Cate

[57] ABSTRACT

A hand covering in the form of a glove which is water proof and provides protection against cutting, puncturing and lacerations as well as thermal insulation for protection against burning of the user's hand when grasping hot objects. A raised silicone pattern is formed on the palm portion of the glove to enhance the heat insulating and gripping abilities of the hand covering.

24 Claims, 1 Drawing Sheet

FIG. 1
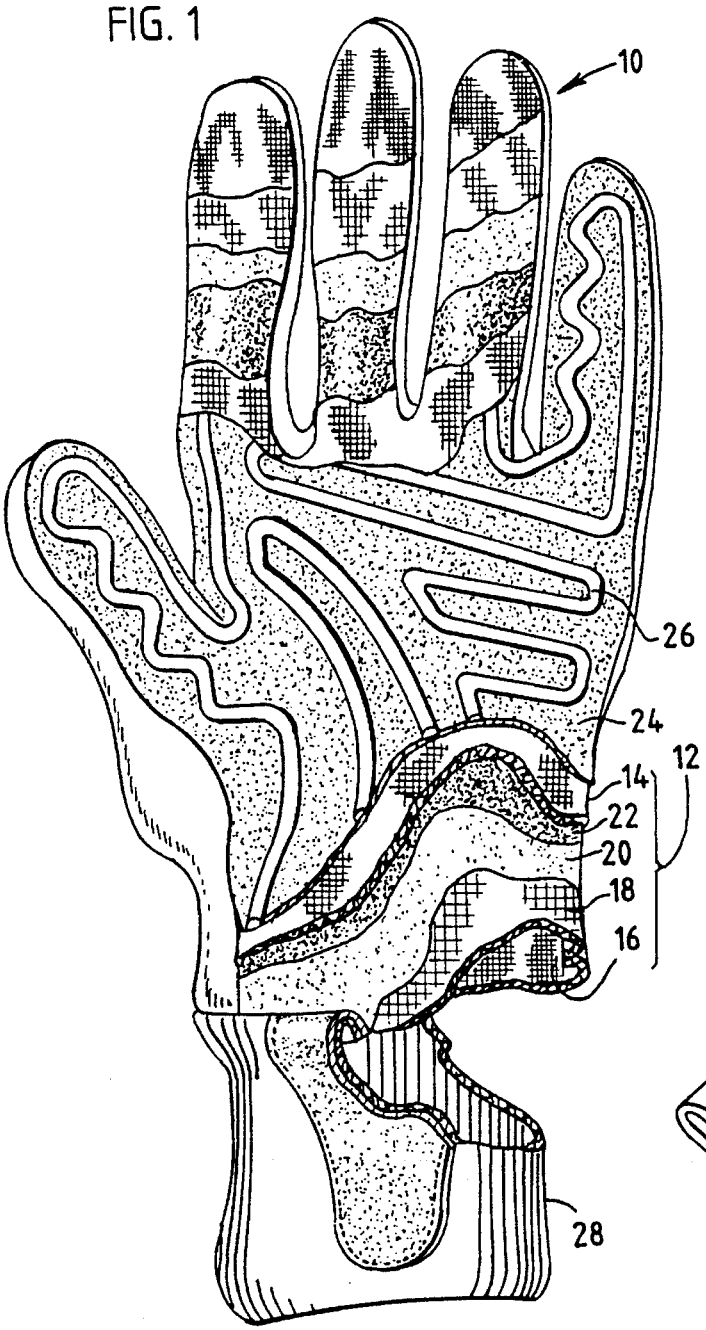
FIG. 2
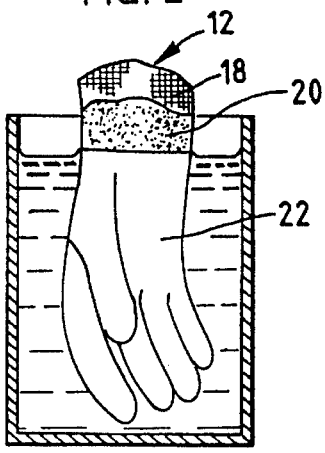
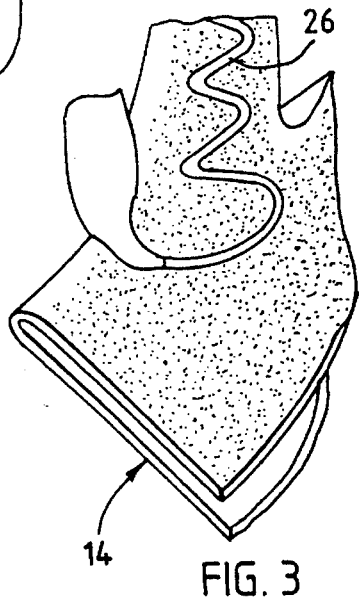
FIG. 3

HEAT RESISTANT AND CUT AND PUNCTURE PROTECTIVE HAND COVERING

BACKGROUND OF THE INVENTION

1. Field of the Invention

The present invention relates to a protective hand covering which is formed of materials resistant to heat, and which provide protection against cutting or puncturing of the hands of the user, and which is liquid proof. Those whose employment brings them in contact with flame, or into the presence of high temperatures, such as firepersons and foundry workers find their hands exposed to conditions capable of bringing about substantial injury to their hands. In the case of a fireperson, the fighting of a structural fire can bring about exposure to a limitless number of unexpected hazards. Cuts, punctures and lacerations may result from grasping or pushing, or brushing against broken glass, sharp metal, nails, wood splinters and innumerable other objects. Further, burns can result from handling hot objects, particularly those which are unexpectedly hot, from contacting open flames, and from being exposed to radiant thermal energy. Due to poor visibility, resulting from smoke and poor lighting, the chances of a fireman subjecting himself to cuts or punctures from grasping a hot object is ever present. Further, it is desirable to provide the users hands with protection from liquids such as blood borne pathogens, gasoline, and hydraulic fluid.

2. Description of Related Art Including

Information Disclosed under Secs. 1.97–1.99

In the past, others have addressed the need to provide hand coverings for the same or similar purposes. Examples of such hand coverings are set forth in the following United States patents:

| U.S. PAT. NO. | INVENTOR | ISSUE DATE |
|---|---|---|
| 2,578,188 | Ionides et al | 12/11/51 |
| 4,302,851 | Adair | 12/1/81 |
| 4,433,439 | Sidman et al | 2/28/84 |
| 4,454,611 | Tschirch et al | 6/19/84 |
| 4,847,918 | Sturm | 7/18/89 |
| 4,869,962 | McCullough Jr. et al | 9/26/89 |
| 4,918,756 | Grilliot et al | 4/24/90 |

The Ionides et al patent reveals a heat-resistant covering comprising three layers, the outer layer of which absorbs a vaporizing agent which is vaporized when subjected to heat. The Adair patent reveals a heat resistant protective hand covering in which a wool knit liner is enclosed within an outer layer of woven KEVLAR aromatic polyamide fiber material with layers of aluminum foil and flexible fiberglass sandwiched therebetween. Secured to the outer layer is a pleated pad of flexible material woven from fiberglass yarns.

The Sidman et al patent reveals a heat-resistant protective glove having first and second shells formed from a temperature-resistant aromatic polyamide fiber such as KEVLAR with the first shell section being made of a twill weave fabric and the second shell being made of a knitted fabric. A liner is formed of two sections, both of which are formed of a felt fabric of a temperature-resistant aromatic polyamide fiber, with the section forming the palm being provided with a flame resistant elastomeric coating.

The Tschirch et al patent reveals a heat-resistant protective hand covering having a fabric shell made of a temperature-resistant aromatic polyamide fiber. The outer surface of the shell is coated with a fire-resistant elastomer. A liner made of a felt fabric of a temperature-resistant aromatic polyamide fiber is disposed within and secured to the shell. A friction-inducing surface is formed by waffling or dimpling the palm side of the glove by incorporating small particles of insoluble material which will cause an irregular surface on a coating.

The Sturm patent reveals a method of manufacturing a protective hand covering wherein a flexible fire-retardant and heat insulating inner glove is mounted within and secured to a flexible water-tight vapor permeable plastic glove. A flexible reinforcement element having the outline of the plastic glove is cemented to one face of the plastic glove to provide securement tabs for stitching or tacking the tips of the fingers of a reversed (i.e., inside-out) leather glove, which is then pulled over the plastic glove and the reinforcement element. The Grilliot et al patent is directed to a waterproof firefighter's glove wherein a sealing piece covers a portion of a waterproof layer attached to a thermal barrier layer which layer is located within the waterproof layer.

SUMMARY OF THE INVENTION

Accordingly, it is an object of this invention to provide a covering for a hand which provides protection from heat as well as cuts, punctures, and abrasion. It is another object of this invention to provide a hand covering, the palm of which provides an enhanced gripping surface. It is a further object to provide a hand covering which is liquid proof so as to protect the users hands from contact with undesirable fluids. It is still another object of this invention to provide the desired protective hand covering with such flexibility that it does not unduly impede the movement of the palm, fingers and thumb, and therefor the ability of a hand to grasp and manipulate an object.

In accordance with this invention, a hand covering is provided which protects the user's hand from cuts, punctures and abrasion and further provides protection from heat, particularly when grasping a hot object. In the preferred embodiment of the invention the hand covering is formed with an hand covering liner which is received within an outer hand covering, both of which are secured to a wrist surrounding member. The hand covering liner is formed with two layers, a first or inner layer and a second or outer layer. The inner layer, which contacts the user's hand, is formed of a strong, heat resistant, cut, puncture and abrasion resistant material such as an aromatic polyamide fiber material, which provides thermal protection and is not irritating to the user's hand. The second or outer layer is formed of cotton or other similar organic materials. A knife coating, that is a thin or scrim coating of a nitrile compound is applied to one side of the outer layer, while the other side of the outer layer is laminated to the inner layer by a laminator using an adhesive such as a latex. After being cut from the laminated material, the palm and back hand portions of the laminated inner and outer layers are secured to each other such as by stitching or sonic welding so as to form a hand covering, typically a glove or mitten.

The second or outer layer of the hand covering liner is then coated with a nitrile compound, so as to form a liquid proof outer bladder on the hand covering liner. The coating may be applied by dipping the hand covering liner into a liquid nitrile compound one or more times. The liquid proof coating or bladder prevents not only water from reaching the first inner layer and the user's hand, but also prevents undesirable contact with such liquids as blood borne pathogens, gasoline, and hydraulic fluid.

An outer hand covering is formed of a heat resistant strong, cut, puncture and abrasion resistant material such as an aromatic polyamide fiber. To enhance both the heat-resistance or thermal protection of the palm portion of the hand covering and also the gripping ability of the user of the hand covering, the palm portion is provided with a very thin coating of silicone material, over which is applied a raised pattern of silicone so as to provide both an enhanced gripping surface, and enhanced heat-resistance. That is, when the outer edge of a raised pattern engages an item grasped by the user of the hand covering, an insulating air space is formed between the thin coating of silicon material and the object being grasped in those areas not provided with the raised pattern.

The silicone forming the raised pattern is applied in a predetermined pattern through a nozzle, with the movement of the nozzle with respect to what is to be the palm portion of the outer glove being controlled by a computer.

The liner is inserted into the outer hand covering, and both the liner and the outer hand covering are secured to a knit wrist or woven cuff which encircle the wearers wrist. The knit wrist or woven cuff is preferably formed of a strong, heat resistant, cut, puncture and abrasion resistant material such as an aromatic polyamide fiber material. The outer surface of the nitrile bladder being a somewhat sticky surface, engages the inner surface of the outer hand covering to hold the hand covering liner in place within the outer hand covering. Thus, it is not necessary to secure, for instance by use of an adhesive or by sewing, the finger tip areas of the liner and the outer hand covering to each other to prevent the liner from pulling out of the outer hand covering as a hand is removed from the hand covering.

BRIEF DESCRIPTION OF THE DRAWING

FIG. 1 is a perspective view, with portions broken away, of a hand covering, shown as a glove, formed and constructed in accordance with this invention.

FIG. 2 is a perspective view showing a method of applying a water proof outer layer to a hand covering liner in accordance with this invention.

FIG. 3 is a perspective view showing a method of applying a raised pattern of high temperature resistant material to an outer hand covering in accordance with this invention.

DETAILED DESCRIPTION OF THE PREFERRED EMBODIMENT

Referring to FIG. 1, a hand covering, in the form of a glove constructed in accordance with this invention is shown. The glove 10 includes an inner liner 12 and an outer shell 14. The inner liner 12 is preferably formed of several layers of material. A preferred material for the inner layer 16, i.e. that which immediately surrounds the hand, is a strong, high temperature resistant, cut, puncture and abrasion resistant fabric, such as one formed from aromatic polyamide fibers. The outer layer 18 of the inner liner 12 is preferably formed of a fabric made of a natural fiber such as cotton. One side of the material forming the outer layer 18 is knife coated with a light scrim coat, i.e. a very thin coat 20, of a nitrile compound. The inner layer 16 is bonded to the non-coated side of the outer layer 18 by a laminator using an adhesive such as latex.

Palm and backhand portions of the glove are then cut from the laminated inner layer 16 and outer layer 18, and secured to each other, such as by stitching or sonic welding, to form the inner liner 12. Thereafter a heavier coating 22 of a nitrile compound is provided on the outer surface of the outer layer 18. In a preferred embodiment of this invention, the heavier coating of nitrile compound is applied to the outer layer 18 by dipping the liner 12 into a liquid bath of a nitrile compound one or more times. For instance, the liner 12 may be dipped into a container filled with a liquid nitrile compound as shown in FIG. 2. After curing, the nitrile compound provides a liquid proof coating or bladder 22 on the liner 12. As an alternative to the nitrile compound, neoprene® can be used. The neoprene® when hardened forms a waterproof bladder over the natural fiber outer layer 18. The neoprene® coating or bladder has the desirable characteristic of being chemically resistant, so as to protect the hand from undesirable contact with fluids such as gasoline and hydraulic fluid.

The outer shell 14 is made from a temperature-resistant aromatic polyamide fiber. The material which is to be used to form the palm portion of the outer shell 14 is provided with a kiss, or very thin coating 24 of silicone. A raised pattern 26 of silicone is applied over the thin coating 24 of silicone so as to provide both an enhanced gripping surface, and enhanced heat-resistance. While a particular raised pattern 26 of silicon is shown, other patterns may well be used with the same beneficial results. In a preferred embodiment of this invention, a two part silicone material is metered and mixed and then applied over the thin coating 24 of silicone through a nozzle as shown in FIG. 3. The nozzle is caused to move with respect to the palm portion of the outer shell 14 so as to form the desired raised pattern 26 of silicone which is thereafter cured. The movement of the nozzle with respect to the palm portion of the outer shell is in a preferred embodiment controlled by a computer. In applying the bead of silicone material to form the raised pattern 26, it is desirable to space the bead away from the edges of the pattern for the palm portion, such that it will not interfere with the securing of the edges of the back and palm portions to each other, such as by sewing or sonic welding. In the preferred method of making the hand covering of this invention, the palm portion of the outer shell is cut from the material after the raised pattern 26 has been formed thereon.

To complete the assembly of the glove, a wristlet 28, also formed of a polyamide fabric is secured to the wrist ends of the inner liner 12 and the outer shell 14. The wristlet is of a suitable length to protect the wrist and lower arm of the user. The wristlet 28, which may be knit or formed as a woven cuff is preferably formed of a strong, high temperature resistant, cut, puncture and abrasion resistant fabric, such as one formed from aromatic polyamide fibers.

In the preferred form of this invention, the inner liner is formed of 6 oz./sq.yd. 100% KEVLAR® inter-lock fabric. However, it is believed that KEVLAR® and other aromatic polyamide fibers such as NOMEX® aromatic polyamide fiber, manufactured by DuPont and P.B.I.® polyamide fiber, manufactured by Celanese, having a weight of 4 to 8 oz./sq. yd., could be used in certain applications of this invention. The preferred fabric for the outer layer 18 of the inner liner 12 is 100% cotton Jersey fabric. Cotton and other natural fiber fabrics having a weight of 4 to 7 oz./sq. yd. would be suitable for use in certain applications of this invention. As set forth above, the waterproof coating or bladder 22 on the liner 12 may be formed of a nitrile compound such as Buna-N, synthetic rubbers or neoprene®. However, other synthetic rubbers, such as Butyl rubber, as well as polyurethane, may be used to form the waterproof bladder.

While the preferred fabric for the outer shell is 9 oz./sq. yd. KEVLAR Jersey fabric, fabrics formed from other aromatic polyamide fibers as mentioned above, having a weight of 8 to 10 oz./sq. yd. would be suitable for use in certain applications of this invention.

It should be apparent to those skilled in the art, that while what has been described is considered at present to be the preferred embodiment of the protective hand covering of this invention, in accordance with the patent statutes, changes may be made in the hand covering without actually departing from the true spirit and scope of this invention.

The appended claims are intended to cover all such changes and modifications which fall within the true spirit and scope of this invention.

We claim:

1. A hand covering having back hand and palm portions, to provide protection of a user's hand from being cut by engagement with sharp objects, from being burned by contact with hot objects, from coming into contact with liquids, and which provides an enhanced gripping surface on the palm side, said hand covering comprising:

a hand covering liner having back and palm portions formed of at least two layers of fabric, a first inner layer made of a strong, high temperature resistant, cut, puncture and abrasion resistant fabric, a second outer layer made of a fabric formed from natural fibers, said first inner layer and second outer layer of said back and palm portions being secured to each other so as to form a hand covering, said second outer layer being coated with a material selected from the group consisting of nitrile compounds, Buna-N synthetic rubbers, neoprene and polyurathane so as to provide a liquid proof outer layer on said hand covering liner, an outer hand covering having back hand and palm portions made of a strong, high temperature resistant, cut, puncture and abrasion resistant fabric, said palm portion being provided with a thin coat of silicone material, a raised pattern of silicone being provide over said thin coat of silicone material so as to provide an enhanced gripping surface, and improved thermal protection, said hard covering liner being received within said outer hard covering.

2. The hand covering of claim 1, wherein said first inner layer and said second outer layer of said hand covering liner are laminated to each other.

3. The hand covering of claim 2, wherein said first inner layer and said second outer layer of said hand covering liner are laminated to each other using a latex adhesive.

4. The hand covering of claim 1, wherein said first inner layer of said hand covering liner is made of a fabric which comprises high temperature resistant aromatic polyamide fibers.

5. The hand covering of claim 4, wherein said fabric has a weight in the range of 4 to 8 oz./sq. yd.

6. The hand covering of claim 4, wherein said first inner layer of said hand covering liner is made of an inter-lock type material.

7. The hand covering of claim 4, wherein said first inner layer of said hand covering liner is made of 6 oz./sq. yard KEVLAR® inter-lock type material.

8. The hand covering of claim 1, wherein said second outer layer of said hand covering liner is made of a natural fiber fabric having a weight in the range of 4 to 7 oz./sq. yd.

9. The hand covering of claim 8, wherein said second outer layer of said hand covering liner is made of a fabric of the Jersey type.

10. The hand covering of claim 1, wherein said second outer layer of said hand covering liner is made of cotton Jersey type material.

11. The hand covering of claim 1, wherein said second outer layer of said hand covering liner is made of cotton Jersey type material having a weight of five and one-half oz./sq. yard.

12. The hand covering of claim 1, wherein said second outer layer of said hand covering liner is coated with a material selected from the group consisting of nitrile compounds, Buna-N synthetic rubbers, neoprene and polyurathane.

13. The hand covering of claim 1, wherein a very light coating of a material selected from the group consisting of nitrile compounds, Buna-N Synthetic rubbers, neoprene and polyurathane is first applied to said second outer layer of said hand covering liner, and thereafter a second heavier coating of a material selected from the group consisting of nitrile compounds, Buna-N synthetic rubbers, neoprene and polyurathane is applied to said hand covering liner so as to enclose the hand covering liner in a waterproof bladder.

14. The hand covering of claim 1, wherein said outer hand covering is made of a fabric which comprises high temperature resistant aromatic polyamide fibers.

15. The hand covering of claim 14, wherein said outer hand covering is made of KEVLAR®.

16. The hand covering of claim 14, wherein said outer hand covering is made of a jersey type material.

17. The hand covering of claim 14, wherein said outer hand covering is made of a fabric having a weight in the range of 8 to 10 oz./sq. yard.

18. The hand covering of claim 14, wherein said outer hand covering is made of 9 oz./sq. yard KEVLAR® jersey type material.

19. The hand covering of claim 1, wherein a wristlet is secured to said hand covering liner and said outer hand covering.

20. The hand covering of claim 19, wherein a wristlet is made of a fabric which comprises high temperature resistant aromatic polyamide fibers.

21. The hand covering of claim 1, wherein said raised pattern of silicone material is formed as a bead extending over the palm portion of the outer hand covering.

22. The hand covering of claim 4, wherein said first inner layer of said hand covering liner is made of KEVLAR®.

23. A method of forming a hand covering having back hand and palm portions, to provide protection of a user's hand from being cut by engagement with sharp objects, or burned by contact with hot objects, and which provides an enhanced gripping surface on the palm side, comprising:

forming a hand covering liner having back and palm portions from at least two layers of fabric, laminating an inner layer of a strong, high temperature resistant, cut, puncture and abrasion resistant fabric, to an outer layer of fabric formed from a natural material to which a thin coating selected from the group consisting of a nitrile compound such as Buna-N, synthetic rubbers or neoprene is applied to the fabric, cutting back and palm portions of said hand covering liner from said laminated inner and outer layers of fabric, securing said back and palm portions of said hand covering liner to each other so as to form a hand covering liner, coating said outer layer of said hand covering liner with a material selected from the group consisting of a nitrile compound such as Buna-N, synthetic rubbers or neoprene® so as to provide a water proof outer layer on said hand covering liner, forming an outer hand covering having back hand and palm portions, cutting a back portion of said outer hand covering from a strong, high temperature resistant, cut, puncture and abrasion resistant fabric, forming a thin coating of silicone material on a strong, high temperature resistant, cut, puncture and abrasion resistant fabric, and thereafter cutting a palm portion of said outer hand covering therefrom, metering and mixing a two part silicone material and applying a bead of the silicone material in a pattern to the palm portion of said outer hand covering so as to provide an enhanced gripping surface, securing said back and palm portions of said outer hand covering to each other so as to form said outer hand covering, placing said hand covering liner in said outer hand covering, and securing said hand covering liner and said outer hand covering to a wristlet.

24. The method of forming a hand covering of claim 23, wherein the step of applying said bead of silicone material in a pattern to the palm portion of said outer hand covering is computer controlled.

* * * * *